US007060655B2

(12) United States Patent
Geuens et al.

(10) Patent No.: US 7,060,655 B2
(45) Date of Patent: Jun. 13, 2006

(54) STABILIZERS FOR USE IN SUBSTANTIALLY LIGHT-INSENSITIVE THERMOGRAPHIC RECORDING MATERIALS

(75) Inventors: Ingrid Geuens, Emblem (BE); Johan Loccufier, Zwijnaarde (BE)

(73) Assignee: AGFA Gevaert, Mortsel (BE)

( * ) Notice: Subject to any disclaimer, the term of this patent is extended or adjusted under 35 U.S.C. 154(b) by 247 days.

(21) Appl. No.: 10/705,477

(22) Filed: Nov. 10, 2003

(65) Prior Publication Data

US 2004/0137388 A1 Jul. 15, 2004

Related U.S. Application Data

(60) Provisional application No. 60/429,284, filed on Nov. 26, 2002.

(30) Foreign Application Priority Data

Nov. 14, 2002 (EP) ..... 02102586

(51) Int. Cl.
*B41M 5/30* (2006.01)

(52) U.S. Cl. ..... 503/212; 503/209

(58) Field of Classification Search ..... 503/212, 503/209

See application file for complete search history.

(56) References Cited

U.S. PATENT DOCUMENTS

| | | | | |
|---|---|---|---|---|
| 4,201,582 | A | 5/1980 | White | |
| 5,672,560 | A * | 9/1997 | Rush | 503/209 |
| 5,686,228 | A | 11/1997 | Murray et al. | |
| 5,922,529 | A | 7/1999 | Tsuzuki et al. | |
| 2001/0038977 | A1 | 11/2001 | Katoh | |
| 2002/0155401 | A1 | 10/2002 | Yamaguchi | |

FOREIGN PATENT DOCUMENTS

| | | | |
|---|---|---|---|
| EP | 0 218 385 | A2 | 4/1987 |
| EP | 0 256 820 | A2 | 2/1988 |
| EP | 0 295 507 | A2 | 12/1988 |
| EP | 0 713 133 | A1 | 5/1996 |
| EP | 0 807 850 | A1 | 11/1997 |
| EP | 0 838 722 | A2 | 4/1998 |
| EP | 0 897 130 | A1 | 2/1999 |
| EP | 0 901 040 | A1 | 3/1999 |
| EP | 0 933 672 | A1 | 8/1999 |
| EP | 1 079 269 | A1 | 2/2001 |
| EP | 1 164 421 | A1 | 12/2001 |
| WO | WO 94/16361 | A1 | 7/1994 |
| WO | WO 96/10213 | A1 | 4/1996 |
| WO | WO 01/96944 | A2 | 12/2001 |

OTHER PUBLICATIONS

Search Report for EP 02 10 2586 (Feb. 27, 2003).

* cited by examiner

*Primary Examiner*—Bruce Hess
(74) *Attorney, Agent, or Firm*—Leydig, Voit & Mayer, Ltd.

(57) ABSTRACT

A substantially light-insensitive black and white monosheet thermographic recording material comprising a support and a thermosensitive element, said thermosensitive element containing a substantially light-insensitive organic silver salt, an organic reducing agent therefor in thermal working relationship therewith, a binder and at least one 2-mercapto-benzothiazole compound represented by formula (I):

(I)

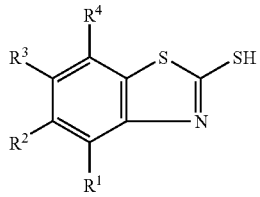

wherein $R^1$, $R^2$, $R^3$ and $R^4$ are independently hydrogen, an optionally substituted alkyl group, an optionally substituted aryl group, an alkoxy group, an ester group, a carbamate group, a carbonate group, a $SO_2R^5$ group, a —$NR^6R^7$ group, a nitro group, a cyano group, an acyl group, a halogen atom, an optionally alkyl or alkoxy-substituted —$SO_2$NH-phenyl group, a perfluoro-alkyl group, a —$CONHR^8$ group, a —$NHOCR^9$ group, a —$OCOOR^{10}$ group or a —$NHCOOR^{11}$ group; $R^5$, $R^9$, $R^{10}$ and $R^{11}$ are independently an optionally substituted alkyl or an aryl group; $R^6$, $R^7$ and $R^8$ are independently a hydrogen atom, an optionally substituted alkyl group or an acyl group; $R^1$ and $R^2$ together, $R^2$ and $R^3$ together and $R^3$ and $R^4$ together can independently represent the atoms necessary to form a carbocyclic, aromatic, heteroaromatic or heterocyclic ring with the proviso that at least one of $R^1$, $R^2$, $R^3$ and $R^4$ is not hydrogen.

20 Claims, No Drawings

STABILIZERS FOR USE IN SUBSTANTIALLY LIGHT-INSENSITIVE THERMOGRAPHIC RECORDING MATERIALS

CROSS-REFERENCE TO RELATED PATENT APPLICATIONS

This application claims the benefit of U.S. Provisional Application No. 60/429,284 filed Nov. 26, 2002, which is incorporated by reference. In addition, this application claims the benefit of European Application No. 02102586.1 filed Nov. 14, 2002, which is also incorporated by reference.

FIELD OF THE INVENTION

The present invention concerns stabilizers for use in substantially light-insensitive thermographic recording materials.

BACKGROUND OF THE INVENTION

Thermography is an image-forming process including a heating step and hence includes photothermography in which the image-forming process includes image-wise exposure and direct thermal processes in which the image-forming process includes an image-wise heating step. In direct thermal printing a visible image pattern is produced by image-wise heating of a recording material.

EP-A 0 218 385 discloses a thermally developable light-sensitive material which has at least one light-sensitive silver halide containing layer on a support and which further contains a compound represented by the general formula (I):

$$X\text{-}(\text{-}(J)_m\text{-}F)_n \qquad (I)$$

wherein X is the residue of the development restrainer; J is a divalent linkage; F is an immobilizing group that is capable of reducing the diffusibility of the compound of formula (I) or a silver salt or silver complex thereof during thermal development; m is 0 or 1; and n is an integer of 1 to 3. EP-A 0 218 385 discloses the following 2-mercapto-benzothiazole compounds:

A-1 =

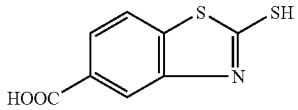

A-10 =

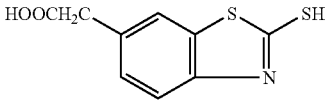

A-42 =

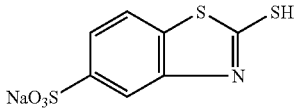

B-14 =

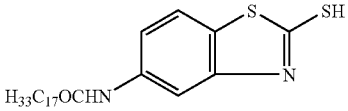

B-15 =

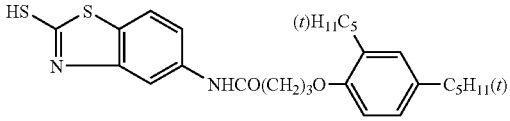

EP-A 0 256 820 discloses a thermal developing light-sensitive material comprising a support and, provided thereon, photographic structural layers comprising at least one layer containing light-sensitive silver halide, said photographic structural layer comprising a compound represented (1):

$$X_1\text{-}L_1\text{-}A \qquad \text{Formula (1)}$$

wherein $X_1$ represents a residual group of a photographic restrainer, $L_1$ is a mere bonding hand or a divalent group and A is selected from the group consisting of a hydrogen atom, an amino group, a hydroxyl group, a carboxyl group or a salt thereof, a sulfo group or a salt thereof and a sulfin group or a salt thereof,and a compound represented by general formula (2):

$$X_2\text{-}L_2\text{-}B \qquad \text{Formula (2)}$$

wherein $X_2$ represents a residual group of a photographic restrainer, $L_2$ is a divalent group and B is a ballast group. EP-A 0 256 820 discloses the following 2-mercapto-benzothiazole compounds:

A-22 =

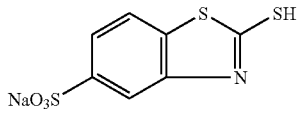

A-57 =

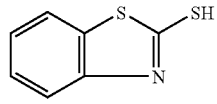

B-15 =

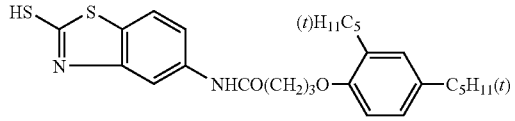

EP-A 0 295 507 discloses a process for the production of colour images by the photographic dye diffusion process in which a first light-sensitive sheet material is imagewise exposed, at least one of said first light-sensitive sheet material and a second light-insensitive sheet material is moistened with an aqueous liquid and the two sheet materials are together heated to 50° to 100° C. with their coated surfaces in contact and then separated, said first sheet material containing, on a layer support, at least one light-sensitive silver halide emulsion layer and at least one non-diffusible colour providing compound which is capable of being decomposed imagewise in the process of development to release a diffusible dye and said second sheet material containing a salt of a strong organic base and a weak acid, wherein said first sheet material contains a combination of compounds corresponding to the following formulae I and II:

(I)

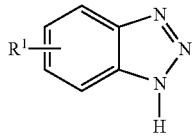

wherein $R^1$ denotes hydrogen, alkyl with up to 6 carbon atoms, halogen, hydroxy, alkoxy or substituents which together form a condensed benzene ring, and (II)

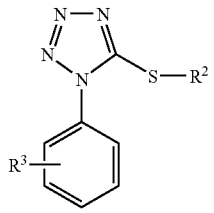

wherein $R^2$ denotes a group which can be split off in the process of development of the material and R denotes hydrogen, halogen, alkyl with up to 4 carbon atoms, alkoxy, carboxy, carbalkoxy, carbonamido or sulphonamido. EP-A 0 295 507 further disclosed that in the above-mentioned process the first, light-sensitive sheet material additionally contains at least one compound corresponding to one of the following formulae III or IV:

(III)

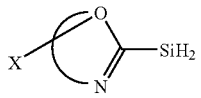

wherein Q denotes the group required for completing a heterocyclic group containing a 5- or 6-membered heterocyclic ring, X denotes a carboxylic or sulphonic acid group or a residue containing a carboxylic or sulphonic acid group; and (IV)

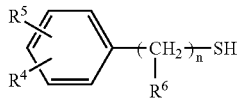

wherein $R^4$ denotes hydrogen, alkyl with up to 18 carbon atoms, alkoxy or halogen, $R^5$ denotes hydrogen or an alkyl group with up to 18 carbon atoms, $R^6$ denotes hydrogen or an alkyl group with up to 3 carbon atoms, and n denotes 0, 1 or 2. EP-A 0 295 507 also discloses

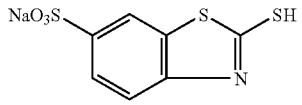

as an effective compound.

EP-A 0 838 722 discloses a photothermographic material comprising (a) a reducible silver source, (b) a photocatalyst, (c) a reducing agent, (d) a binder, and (e) at least one compound of the following general formula (I): $X\text{-}L_1\text{-}D$ wherein D is an electron donative group of atoms, with the proviso that where D is a hydrazino group which is not a part of a semicarbazido group, no oxo group is substituted to the carbon atom which is directly attached to a nitrogen atom of the hydrazine, X ia a group capable of promoting adsorption to silver halide, and $L_1$ is a valence bond or a linking group. EP-A 0 838 722 discloses at page 15 the following 2-mercapto-benzothiazole compound under the number 24:

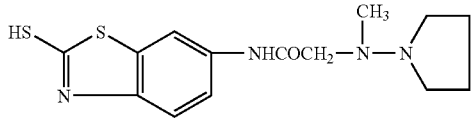

U.S. Pat. No. 5,922,529 discloses a photothermographic material comprising a binder, an organic silver salt, a reducing agent for silver ion, and photosensitive silver halide grains on at least one surface of a support, wherein a photosensitive layer containing the photosensitive silver halide grains further contains a compound of the formula (I) and a compound of the formula (II), and said photosensitive layer has an absorbance of 0.15 to 1.0 at an exposure wavelength, $$R\text{—}S(M)_n \qquad (I)$$

wherein R is an aliphatic hydrocarbon, aryl or heterocyclic group, M is a hydrogen atom or cation, and letter n is a number determined so as to render the molecule neutral,

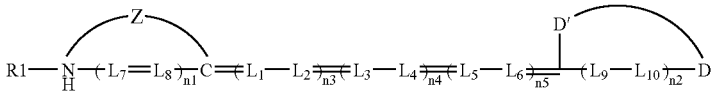

$(M_1)_{m1}$ wherein $Z_1$ is a group of atoms necessary to form a 5- or 6-membered nitrogenous heterocycle, each of D and D' ia a group of atoms necessary to form an acyclic or cyclic acidic nucleus, $R_1$ is an alkyl group, $L_1$, $L_2$, $L_3$, $L_3$, $L_4$, $L_5$, $L_6$, $L_7$, $L_8$, $L_9$ and $L_{10}$ each are a methine group, which may form a ring with another methine group or a ring with an auxochrome, letters n1, n2, n3, n4, and n5 each are equal to 0 or 1, $M_1$ is an electric charge neutralizing counter ion, and letter m1 is an integer inclusive of 0 necessary to neutralize an electric charge in a molecule. U.S. Pat. No. 5,922,529 further discloses the following 2-mercapto-benzothiazole compounds as being compounds falling under formula (I):

I-148 =

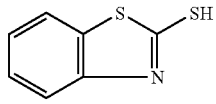

I-149 =

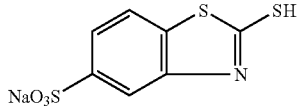

-continued

I-150 =

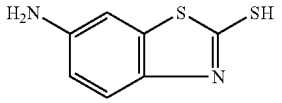

I-151 =

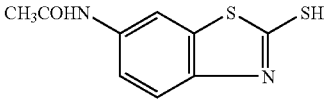

I-152 =

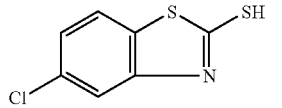

I-153 =

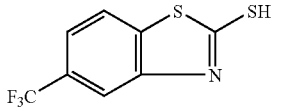

I-154 =

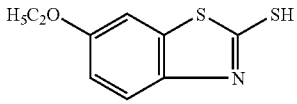

I-155 =

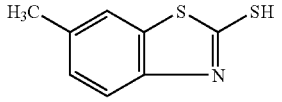

I-156 =

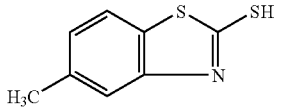

I-157 =

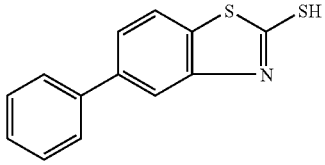

I-158=

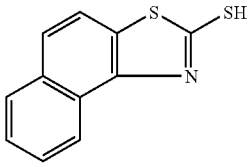

I-159 =

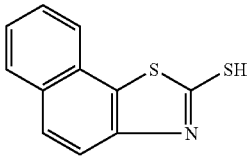

The use of various 2-mercapto-benzothiazole compounds in photothermographic recording materials is disclosed in EP-A 218 385, EP-A 256 820, EP-A 295 507, EP-A 838 722 and U.S. Pat. No. 5,922,529. However, the technology of substantially light-insensitive thermographic materials containing substantially light-insensitive organic silver salts is substantially different from that of photothermographic materials containing substantially-light-insensitive organic silver salts, despite the fact that in both cases the image results from the reduction of organic silver salts. However, this a superficial similarity masking the fact that the realization of the species which catalyze this reduction is completely different, being image-wise exposure of photosensitive silver halide-containing photo-addressable thermally developable elements in the case of photothermographic recording materials and image-wise heating of thermosensitive elements which do not contain photosensitive silver halide in the case of thermographic recording materials. This difference in technology is further underlined by the nature of the ingredients used in the two types of materials, the most significant difference being the absence of photosensitive silver halide and spectral sensitizing agents in substantially light-insensitive thermographic recording materials, but also reflected in the different reducing agents used, stronger reducing agents being used in substantially light-insensitive thermographic recording materials, the different stabilizers, the different toning agents etc. Furthermore, the thermal development processes themselves are significantly different in that the whole material is heated at temperatures of less than 150° C. for periods of seconds (e.g. 10 s) in the case of photothermographic recording materials, whereas in the case of substantially light-insensitive thermographic recording materials the materials are image-wise heated at much higher temperatures for periods of ms (e.g. 3–20 ms). Moreover, thermal development in substantially light-insensitive thermographic recording materials involves the liquid crystalline phases of the organic silver salts, whereas this is not the case in the thermal development step in the case of photothermographic recording materials even when using the same organic silver salts. Realization of a neutral image tone is a major problem in the case of substantially light-insensitive thermographic recording materials due to the very short heating times, whereas it is much less of a problem in photothermographic recording materials due to the much longer heating times.

EP-A 0 713 133 discloses a thermal imaging system consisting of (i) a donor element comprising on a support a donor layer containing a binder and a thermotransferable reducing agent capable of reducing a silver source to metallic silver and (ii) a receiving element comprising on a support a receiving layer comprising a silver source, capable of being reduced by means of heat in the presence of a reducing agent, a binder and a stabiliser selected from the group consisting of benzotriazoles, heterocyclic mercaptanes, sulphinic acids, 1,3,4-triazo-indinolines, 1,3-dinitroaryl compounds, 1,2,3-triazoles, phthalic acids and phthalic acid derivatives.

EP-A 0 901 040 discloses a substantially light-insensitive monosheet recording material comprising a support and a thermosensitive element containing a substantially light-insensitive organic silver salt, an organic reducing agent therefor in thermal working relationship therewith and a binder, characterized in that said thermosensitive element further contains an unsaturated carbocyclic or heterocyclic stabilizer compound substituted with a—SA group where A is hydrogen, a counterion to compensate the negative charge of the thiolate group or a group forming a symmetrical or an asymmetrical disulfide and said recording material is capable of producing prints with a numerical gradation value defined as the quotient of the fraction $(2.5–0.1)/(E_{2.5}–E_{0.1})$ greater than 2.3, where $E_{2.5}$ is the energy in Joule applied in a dot area of 87 μm×87 μm of the imaging layer that produces an optical density value of 2.5, and $E_{0.1}$, is the energy in Joule applied in a dot area of the imaging layer material that produces an optical density value of 0.1. EP-A 0 901 040 discloses the following 2-mercapto-benzothiazole compound:

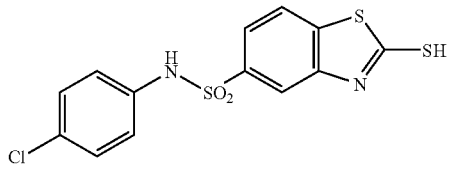

WO 94/16361 discloses a multilayer heat-sensitive material which comprises: a color-forming layer comprising: a color-forming amount of finely divided, solid colorless noble metal or iron salt of an organic acid distributed in a carrier composition; a color-developing amount of a cyclic or aromatic organic reducing agent, which at thermal copy and printing temperatures is capable of a color-forming reaction with the noble metal or iron salt; and an image-toning agent; characterized in that (a) the carrier composition comprises a substantially water-soluble polymeric carrier and a dispersing agent for the noble metal or iron salt and (b) the material comprises a protective overcoating layer for the color-forming layer. Furthermore, WO 94/16361 discloses that suitable antifoggants are well-known photographic anti-foggants such as mercaptobenzotriazole, chromate, oxalate, citrate, carbonate, benzotriazole (BZT), 5-methylbenzotriazole, 5,6-dimethylbenzotriazole, 5-bromobenzotriazole, 5-chlorobenzotriazole, 5-nitro-benzotriazole, 4-nitro-6-chlorobenzotriazole, 5-nitro-6-chlorobenzotriazole, 4-hydroxy-6-methyl-1,3,3a,7-tetraazaindene, benzimidazole, 2-methylbenzimidazole, 5-nitrobenzimidazole, 1-phenyl-5-mercaptotetrazole, 2-mercaptobenzimidazole, 2-mercaptobenzothiazole, 2-mercaptobenzoxazole, 2-mercaptothiazoline, 2-mercapto-4-methyl-6,6'-dimethylpyrimidine, 1-ethyl-2-mercapto-5-amino-1,3,4-triazole, 1-ethyl-5-mercapto-1,2,3,4-tetrazole, 2,5-dimercapto-1,3,4-thiodiazole, 2-mercapto-5-aminothiodiazole, dimethyldithiocarbamate, and diethyldithiocarbamate.

WO 96/10213 discloses a thermographic imaging element comprising a substrate having coated on at least one surface thereof a thermographic imaging system comprising at least one layer comprising light-insensitive organic silver salt; reducing agent for silver ion; binder; toner; and a dye which absorbs radiation in the wavelength range of 750–1100 nm, wherein said at least one layer comprising said light-insensitive organic silver salt forms an image density greater than about 1.0 when exposed to 0.10–2.0 joules/cm$^2$ of said radiation in 0.20 to 200 microseconds. WO 96/10213 does not disclose a stabilizer against the influence of light, but mentions the optional incorporation of benzotriazole in the thermographic imaging element, but only exemplifies the incorporation of benzotriazole.

Substantially light-insensitive thermographic recording materials contain the imaging-forming components both before and after image formation and unwanted image-forming must be hindered both during storage prior to printing and in prints exposed to light on light-boxes e.g. during examination by radiologists. Furthermore, such stabilization must take place without adverse effects upon the image quality-particularly the image tone. Thermographic printers are being introduced with ever higher throughputs, which require thermographic recording materials able to provide stabilization without an adverse effect on the image quality at such faster throughputs. There is therefore a need for stabilizers which fulfil these requirements.

ASPECTS OF THE INVENTION

It is therefore an aspect of the present invention to provide stabilizers for use in substantially light-insensitive thermographic recording materials suitable for use in high throughput thermographic printers without adverse effect on the image tone.

Further aspects and advantages of the invention will become apparent from the description hereinafter.

SUMMARY OF THE INVENTION

It has been surprisingly found that specific types of 2-mercapto-benzothiazole compounds provide effective stabilization in substantially light-insensitive thermographic recording materials suitable for use in high throughput thermographic printers without an adverse effect on the image tone as characterized by CIELAB a* and b* values. The L*, a* and b* CIELAB-values were determined by spectrophotometric measurements according to ASTM Norm E179-90 in a R(45/0) geometry with evaluation according to ASTM Norm E308-90.

Aspects of the present invention are realized with a substantially light-insensitive black and white monosheet thermographic recording material comprising a support and a thermosensitive element, said thermosensitive element containing a substantially light-insensitive organic silver salt, an organic reducing agent therefor in thermal working relationship therewith, a binder and at least one 2-mercapto-benzothiazole compound represented by formula (I):

(I)

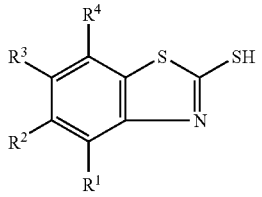

wherein $R^1$, $R^2$, $R^3$ and $R^4$ are independently hydrogen, an optionally substituted alkyl group, an optionally substituted aryl group, an alkoxy group, an ester group, a carbamate group, a carbonato group, a $SO_2R^5$ group, a —$NR^6R^7$ group, a nitro group, a cyano group, an acyl group, a halogen atom, an optionally alkyl or alkoxy-substituted —$SO_2$NH-phenyl group, a perfluoro-alkyl group, a —$CONHR^8$ group, a —$NHOCR^9$ group, a —$OCOOR^{10}$ group or a —$NHCOOR^{11}$ group; $R^5$, $R^9$, $R^{10}$ and $R^{11}$ are independently an optionally substituted alkyl or an aryl group; $R^6$, $R^7$ and $R^8$ are independently a hydrogen atom, an optionally substituted alkyl group or an acyl group; $R^1$ and $R^2$ together, $R^2$ and $R^3$ together and $R^3$ and $R^4$ together can independently represent the atoms necessary to form a carbocyclic, aromatic, heteroaromatic or heterocyclic ring with the proviso that at least one of $R^1$, $R^2$, $R^3$ and $R^4$ is not hydrogen.

Preferred embodiments of the present invention are disclosed in the detailed description of the invention.

DETAILED DESCRIPTION OF THE INVENTION

Definitions

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethylpropyl, 2,2-dimethylpropyl and 2-methyl-butyl etc.

The term acyl group as used in disclosing the present invention means —(C═O)-aryl and —(C═O)-alkyl groups.

The L*, a* and b* CIELAB-values are defined in ASTM Norm E179-90 in a R(45/0) geometry with evaluation according to ASTM Norm E308-90.

Substantially light-insensitive means not intentionally light sensitive.

Heating in association with the expression a substantially water-free condition as used herein, means heating at a temperature of 80 to 250° C. The term "substantially water-free condition" as used herein means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Thermosensitive Element

The term thermosensitive element as used herein is that element which contains all the ingredients, which contribute to image formation. According to the present invention, the thermosensitive element contains one or more substantially light-insensitive organic silver salts, one or more reducing agents therefor in thermal working relationship therewith and a binder. The element may comprise a layer system in which the above-mentioned ingredients may be dispersed in different layers, with the proviso that the substantially light-insensitive organic silver salts are in reactive association with the reducing agents i.e. during the thermal development process the reducing agent must be present in such a way that it is able to diffuse to the particles of substantially light-insensitive organic silver salt so that reduction to silver can occur. Such materials include the possibility of one or more substantially light-insensitive organic silver salts and/or one of more organic reducing agents therefor being encapsulated in heat-responsive microcapsules, such as disclosed in EP-A 0 736 799 herein incorporated by reference.

2-mercapto-benzothiazole Compounds

Aspects of the present invention are realized with a substantially light-insensitive black and white monosheet thermographic recording material of the present invention can contain at least one 2-mercapto-benzothiazole compound represented by formula (I):

(I)

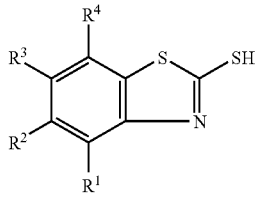

wherein $R^1$, $R^2$, $R^3$ and $R^4$ are independently hydrogen, an optionally substituted alkyl group, an optionally substituted aryl group, an alkoxy group, an ester group, a carbamate group, a carbonato group, a $SO_2R^5$ group, a —$NR^6R^7$ group, a nitro group, a cyano group, an acyl group, a halogen atom, an optionally alkyl or alkoxy-substituted —$SO_2$NH-phenyl group, a perfluoro-alkyl group, a —$CONHR^8$ group, a —$NHOCR^9$ group, a —$OCOOR^{10}$ group or a —$NHCOOR^{11}$ group; $R^5$, $R^9$, $R^{10}$ and $R^{11}$ are independently an optionally substituted alkyl or an aryl group; $R^6$, $R^7$ and $R^8$ are independently a hydrogen atom, an optionally substituted alkyl group or an acyl group; $R^1$ and $R^2$ together, $R^2$ and $R^3$ together and $R^3$ and $R^4$ together can independently represent the atoms necessary to form a carbocyclic, aromatic, heteroaromatic or heterocyclic ring with the proviso that at least one of $R^1$, $R^2$, $R^3$ and $R^4$ is not hydrogen. Preferred optional substitutents for the optionally substituted alkyl and aryl groups are halogen atoms, groups containing a 2-mercapto-benzothiazole moiety and alkyl, alkoxy, mercapto and hydroxy groups.

According to a first embodiment of the substantially light-insensitive black and white monosheet thermographic recording material of the present invention, the at least one benzothiazole compound according to formula (I) is a 2-mercapto-benzothiazole compound substituted by an alkyl, an aryl, an alkoxy, a nitro, a cyano or an acyl group or a halogen atom.

According to a second embodiment of the substantially light-insensitive black and white monosheet thermographic recording material, according to the present invention, the at least one stabilizer is

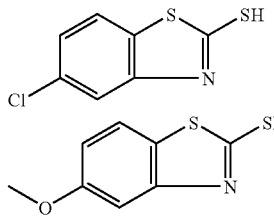

According to a third embodiment of the substantially light-insensitive black and white monosheet thermographic recording material, according to the present invention, the at least one stabilizer is

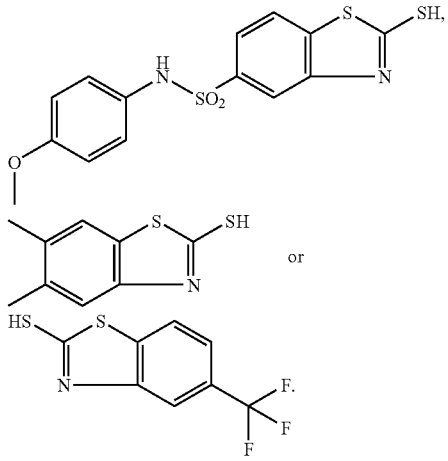

The 2-mercapto-benzothiazole compounds represented by formula (I), according to the present invention, can be prepared from readily available starting materials using standard organic chemistry techniques known to one skilled in the art and available in such reference books such as Houben-Weyl.

Suitable 2-mercapto-benzothiazole (MBT) compounds, according to the present invention, include:

| MBT-nr. | Structure |
|---|---|
| MBT-1 | 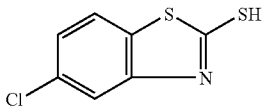 |
| MBT-2 | 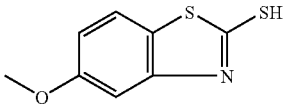 |
| MBT-3 | 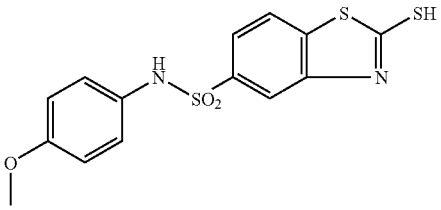 |
| MBT-4 | 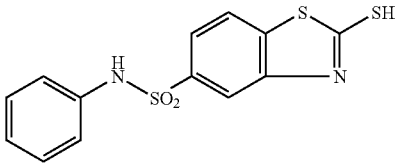 |
| MBT-5 | 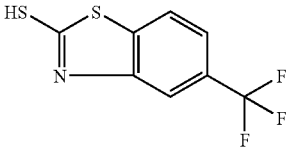 |
| MBT-6 | 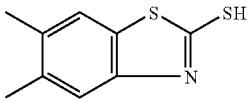 |
| MBT-7 | 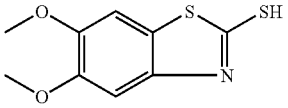 |
| MBT-8 | 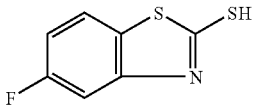 |
| MBT-9 | 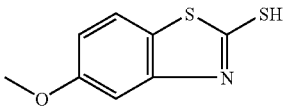 |
| MBT-10 | 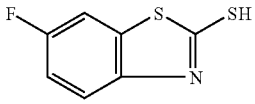 |

-continued

| MBT-nr. | Structure |
|---|---|
| MBT-11 | 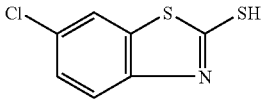 |
| MBT-12 | 5-phenyl-2-mercapto-benzothiazole |
| MBT-13 | 6-phenyl-2-mercapto-benzothiazole |
| MBT-14 | 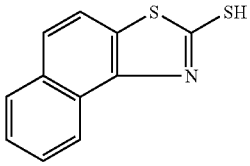 |
| MBT-15 | 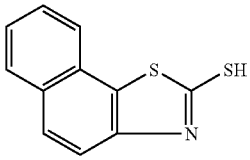 |

Organic Silver Salt

According to a fourth embodiment of the substantially light-insensitive black and white monosheet thermographic recording material of the present invention, the organic silver salts are not double organic salts containing a silver cation associated with a second cation e.g. magnesium or iron ions.

According to a fifth embodiment of the substantially light-insensitive black and white monosheet thermographic recording material of the present invention, at least one of the organic silver salts is a substantially light-insensitive silver salt of an organic carboxylic acid.

According to a sixth embodiment of the substantially light-insensitive black and white monosheet thermographic recording material of the present invention, at least one of the organic silver salts is a substantially light-insensitive silver salt of an aliphatic carboxylic acids known as a fatty acid, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention, as disclosed in EP-A 964 300.

Organic silver salts may be dispersed by standard dispersion techniques. Ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and more finely ground dispersions of organic silver salts.

Reducing Agents

According to an seventh embodiment of the black and white thermographic recording material, according to the present invention, the reducing agent is an organic compound containing at least one active hydrogen atom linked to O, N or C, such as is the case with, aromatic di- and tri-hydroxy compounds. 1,2-dihydroxybenzene derivatives, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters are preferred, with those described in EP-A 0 692 733 and EP-A 0 903 625 being particularly preferred.

Combinations of reducing agents may also be used that on heating become reactive partners in the reduction of the one or more substantially light-insensitive organic silver salt. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130.

Binder of the Thermosensitive Element

The film-forming binder of the thermosensitive element may be all kinds of natural, modified natural or synthetic resins or mixtures of such resins, in which the at least one organic silver salt can be dispersed homogeneously either in aqueous or solvent media: e.g. cellulose derivatives, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylates, polymethacrylates, polystyrene and polyethylene or mixtures thereof.

Suitable water-soluble film-forming binders for use in thermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders, polysaccharides and water-soluble cellulose derivatives. A preferred water-soluble binder for use in the thermographic recording materials of the present invention is gelatine.

The binder to organic silver salt weight ratio is preferably in the range of 0.2 to 7, and the thickness of the thermosensitive element is preferably in the range of 5 to 50 μm. Binders are preferred which do not contain additives, such as certain antioxidants (e.g. 2,6-di-tert-butyl-4-methylphenol), or impurities which adversely affect the thermographic properties of the thermographic recording materials in which they are used.

Toning Agent

According to an eighth embodiment of the black and white monosheet thermographic recording material, according to the present invention, the thermosensitive element contains a toning agent, which enables a neutral black image tone to be obtained in the higher densities and neutral grey in the lower densities.

According to a ninth embodiment of the black and white monosheet thermographic recording material, according to the present invention, the thermosensitive element further contains a toning agent selected from the group consisting of phthalimides, phthalazinones, benzoxazine diones and naphthoxazine diones e.g. phthalimides and phthalazinones within the scope of the general formulae described in U.S. Pat. No. 4,082,901; the toning agents described in U.S. Pat. Nos. 3,074,809, 3,446,648 and 3,844,797; and the heterocyclic toner compounds of the benzoxazine dione or naphthoxazine dione type as disclosed in GB 1,439,478, U.S. Pat. No. 3,951,660 and U.S. Pat. No. 5,599,647, herein incorporated by reference.

According to a tenth embodiment of the substantially light-insensitive black and white monosheet thermographic recording material, according to the present invention, the substantially light-insensitive thermographic material contains a thermosensitive element, the thermosensitive element containing one or more toning agents selected from the group consisting of phthalazinone, benzo[e][1,3]oxazine-2,4-dione, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

Auxiliary Antifoggants

According to an eleventh embodiment of the black and white monosheet thermographic recording material, according to the present invention, the thermographic recording material further contains an auxiliary antifoggant to obtain improved shelf-life and reduced fogging.

According to a twelfth embodiment of the black and white monosheet thermographic recording material, according to the present invention, the thermographic recording material further contains an antifoggant selected from the group consisting of benzotriazole, substituted benzotriazoles and aromatic polycarboxylic acid such as ortho-phthalic acid, 3-nitro-phthalic acid, tetrachlorophthalic acid, mellitic acid, pyromellitic acid and trimellitic acid and anhydrides thereof.

According to a thirteenth embodiment of the black and white monosheet thermographic recording material, according to the present invention, the thermosensitive element further contains an optionally substituted benzotriazole.

Polycarboxylic Acids and Anhydrides Thereof

According to a fourteenth embodiment of the black and white monosheet thermographic recording material, according to the present invention, the thermosensitive element further contains at least one polycarboxylic acid and/or anhydride thereof in a molar percentage of at least 15 with respect to all the organic silver salt(s) present and in thermal working relationship therewith. The polycarboxylic acid may be aliphatic (saturated as well as unsaturated aliphatic and also cycloaliphatic) or an aromatic polycarboxylic acid, may be substituted and may be used in anhydride form or partially esterified on the condition that at least two free carboxylic acids remain or are available in the heat recording step.

Surfactants and Dispersants

Surfactants and dispersants aid the dispersion of ingredients which are insoluble in the particular dispersion medium. The substantially light-insensitive thermographic material used in the present invention may contain one or more surfactants, which may be anionic, non-ionic or cationic surfactants and/or one or more dispersants. Suitable dispersants are natural polymeric substances, synthetic polymeric substances and finely divided powders, e.g. finely divided non-metallic inorganic powders such as silica.

Support

According to a fifteenth embodiment of the substantially light-insensitive black and white monosheet thermographic recording material, according to the present invention, the support is transparent or translucent. It is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated thermosensitive element. The support may be dyed or pigmented to provide a transparent coloured background for the image.

Protective Layer

According to a sixteenth embodiment of the substantially light-insensitive black and white monosheet thermographic recording material, according to the present invention, the thermosensitive element is provided with a protective layer. In general this protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating. A slipping layer, being the outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder.

Coating Techniques

The coating of any layer of the substantially light-insensitive thermographic material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

Thermographic Processing

Thermographic imaging is carried out by the image-wise application of heat either in analogue fashion by direct exposure through an image or by reflection from an image, or in digital fashion pixel by pixel either by using an infra-red heat source, for example with a Nd-YAG laser or other infra-red laser, with a substantially light-insensitive thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200–1000 g/linear cm, i.e. with a contact zone (nip) of 200 to 300 μm a pressure of 5000 to 50,000 g/cm$^2$, to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Industrial Application

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated.

Subbing layers on the emulsion side of the support:

Subbing layer Nr. 01 has the composition:

| | |
|---|---|
| copolymer of 88% vinylidene chloride, 10% methyl acrylate and 2% itaconic acid | 79.1 mg/m$^2$ |
| Kieselsol ® 100 F, a colloidal silica from BAYER | 18.6 mg/m$^2$ |
| Mersolat ® H, a surfactant from BAYER | 0.4 mg/m$^2$ |
| Ultravon ® W, a surfactant from CIBA-GEIGY | 1.9 mg/m$^2$ |

Subbing layer Nr. 02 has the composition:

| | |
|---|---|
| copolymer of 88% vinylidene chloride, 10% methyl acrylate and 2% itaconic acid | 151 mg/m$^2$ |
| Kieselsol ® 100 F, a colloidal silica from BAYER | 35 mg/m$^2$ |
| Mersolat ® H, a surfactant from BAYER | 0.75 mg/m$^2$ |

Ingredients in the thermosensitive element in addition to the above-mentioned ingredients:

| | |
|---|---|
| BL5HP = | S-LEC BL5HP, a polyvinyl butyral from SEKISUI; |
| Oil = | BAYSILON, a silicone oil from BAYER; |
| VL = | DESMODUR VL, a 4,4'-diisocyanatodiphenylmethane from BAYER; |
| Reducing agents: | |
| R01 = | 3,4-dihydroxybenzonitrile; |
| R02 = | 3,4-dihydroxybenzophenone; |
| Toning agent: | |
| T01 = | 7-(ethylcarbonato)-benzo[e] [1,3]oxazine-2,4-dione; |
| T02 = | 7-methyl-benzo[e] [1,3]oxazine-2,4-dione; |
| Stabilizers: | |
| S01 = | glutaric acid |
| S02 = | tetrachlorophthalic acid anhydride |
| S03 = | benzotriazole |

-continued

MBT-C1 =

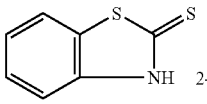

2-mercapto-benzothiazole

MBT-C2 =

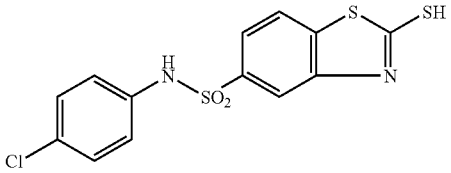

Ingredients in the protective layer:

| | |
|---|---|
| ERCOL ™ 48 20 = | a polyvinylalcohol from ACETEX EUROPE; |
| LEVASIL ™ VP AC 4055 = | a 15% aqueous dispersion of colloidal silica with acid groups predominantly neutralized with sodium ions and a specific surface are of 500 $m^2/g$, from BAYER AG has been converted into the ammonium salt; |
| ULTRAVON ™ W = | 75–85% concentrate of a sodium arylsulfonate from Ciba Geigy converted into acid form by passing through an ion exchange column; |
| SYLOID ™ 72 = | a silica from Grace; |
| SERVOXYL ™ VPDZ 3/100 = | a mono [isotridecyl polyglycolether (3 EO)] phosphate, from SERVO DELDEN B.V.; |
| SERVOXYL ™ VPAZ 100 = | a mixture of monolauryl and dilauryl phosphate, from SERVO DELDEN B.V.; |
| MICROACE TALC P3 = | an Indian talc from NIPPON TALC; |
| RILANIT ™ GMS = | a glycerine monotallow acid ester, from HENKEL AG |
| TMOS | tetramethylorthosilicate hydrolyzed in the presence of methanesulfonic acid. |

COMPARATIVE EXAMPLES 1 AND 2 AND INVENTION EXAMPLE 1 AND 2

The substantially light-insensitive thermographic materials of COMPARATIVE EXAMPLES 1 and 2 and INVENTION EXAMPLE 1 and 2 were prepared by coating a dispersion with the following ingredients in 2-butanone onto a 175 μm thick blue-pigmented polyethylene terephthalate support with CIELAB a*- and b*-values of −9.5 and −17.9 respectively subbed on the emulsion-coated side with subbing layer 01 giving layers after drying at 50° C. for 1 h in a drying cupboard with the compositions given in Table 1.

The thermosensitive elements were then coated with an aqueous composition with the following ingredients, which was adjusted to a pH of 3.8 with 1N nitric acid, to a wet layer thickness of 85 μm and then dried at 50° C. for 15 minutes to produce a protective layer PRO-L with the composition:

| | |
|---|---|
| ERCOL ™ 48 20 = | 2.1 $g/m^2$ |
| LEVASIL ™ VP AC 4055 = | 1.05 $g/m^2$ |
| ULTRAVON ™ W = | 0.075 $g/m^2$ |
| SYLOID ™ 72 = | 0.09 $g/m^2$ |
| SERVOXYL ™ VPDZ 3/100 = | 0.075 $g/m^2$ |
| SERVOXYL ™ VPAZ 100 = | 0.075 $g/m^2$ |
| MICROACE TALC P3 = | 0.045 $g/m^2$ |
| RILANIT ™ GMS = | 0.15 $g/m^2$ |
| TMOS = | 0.87 $g/m^2$ (assuming that the TMOS was completely converted to $SiO_2$) |

After coating the protective layer was hardened by heating the substantially light-insensitive thermographic material at 45° C. for 7 days at a relative humidity of 70%.

Thermographic Printing

The substantially light-insensitive thermographic recording materials of COMPARATIVE EXAMPLES 1 and 2 and INVENTION EXAMPLE 1 and 2 were printed using a DRYSTAR™ 4500 printer from AGFA-GEVAERT with a resolution of 508 dpi which had been modified to operate at a printing speed of 14 mm/s and a line-time of 3.5 ms instead of 7.1 ms and in which the 75 μm long (in the transport direction) and 50 μm wide thermal head resistors were power-modulated to produce different image densities.

The maximum densities of the images ($D_{max}$) measured through a visible filter with a MACBETH™ TR924 densitometer were all greater than 2.2.

Evaluation of Thermographic Properties

The image tone of fresh prints made with the substantially light-insensitive thermographic recording materials of COMPARATIVE EXAMPLES 1 and 2 and INVENTION EXAMPLE 1 and 2 was assessed on the basis of the L*, a* and b* CIELAB-values at optical densities, D, of 1.0 and 2.0 and the results given in Table 2.

TABLE 1

| | stabilizer | | AgBeh | | R01 | R02 | T01 | T02 | S01 | S02 | | |
|---|---|---|---|---|---|---|---|---|---|---|---|---|
| | type | conc. mol % vs AgB | cover-age [$g/m^2$] | BL5HP [$g/m^2$] | mol % vs AgB | mol % vs AgB | mol % vs AgB | mol % vs AgB | mol % vs AgB | mol % vs AgB | VL [$g/m^2$] | Oil [$g/m^2$] |
| Comparative example nr. | | | | | | | | | | | | |
| 1 | S03 | 10 | 3.89 | 15.12 | 50 | 30 | 5 | 10 | 22 | 5 | 0.17 | 0.035 |
| 2 | MBT-C1 | 10 | 3.89 | 15.12 | 50 | 30 | 5 | 10 | 22 | 5 | 0.17 | 0.035 |
| Invention example nr | | | | | | | | | | | | |
| 1 | MBT-1 | 10 | 3.89 | 15.12 | 50 | 30 | 5 | 10 | 22 | 5 | 0.17 | 0.035 |
| 2 | MBT-2 | 10 | 3.89 | 15.12 | 50 | 30 | 5 | 10 | 22 | 5 | 0.17 | 0.035 |

Archivability Tests:

Simulated long-term archivability tests were performed by heating prints made with the substantially light-insensitive thermographic recording materials of COMPARATIVE EXAMPLES 1 and 2 and INVENTION EXAMPLE 1 and 2 at 57° C. in 34% relative humidity in the dark for 3 days and determining the shifts in CIELAB a*- and b*-values. The results are also given in Table 2.

Light-box Tests:

Light-box tests were performed by exposing the substantially light-insensitive thermographic materials of COMPARATIVE EXAMPLES 1 and 2 and INVENTION EXAMPLE 1 and 2 for 3 days on top of the white PVC window of a specially constructed light-box placed in a Votsch conditioning cupboard set at 30° C. and a relative humidity of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 Planilux? TLD 36W/54 fluorescent lamps 27 mm in diameter mounted length-wise equidistantly from the two sides, with the lamps positioned equidistantly to one another and the sides over the whole width of the light-box and with the tops of the fluorescent tubes 30 mm below the bottom of the white PVC plate and 35 mm below the materials being tested. The shifts in CIELAB a*- and b*-values at an optical density, D, of 1.0 and the shift in the CIELAB b*-value were determined for COMPARATIVE EXAMPLES 1 and 2 and INVENTION EXAMPLE 1 and 2 and the results are also given in Table 2.

In light-box tests the substantially light-insensitive thermographic recording materials of INVENTION EXAMPLES 1 and 2 containing the compounds MBT-1 and MBT-2 respectively, according to the present invention, exhibit substantially lower shifts in CIELAB b*-values at an optical density, D, of 1.0 and in CIELAB b*-value at Dmin than that of COMPARATIVE EXAMPLE 2 containing the compound MBT-C1. Thus the substituted 2-mercapto-benzothiazoles MBT-1 and MBT-2 endow substantially light-insensitive thermographic recording materials with a substantially higher light stability than unsubstituted 2-mercapto-benzothiazole, MBT-C1.

TABLE 2

| | stabilizer | b* CIELAB-values of prints with fresh film | | Shift of b* CIELAB-values, Δb*, of prints after 3d/30° C./85% RH light-box exposure | |
|---|---|---|---|---|---|
| | type | D = 1.0 | D = 2.0 | D = 1.0 | Dmin |
| Comparative Example nr. | | | | | |
| 1 | S03 | −5.92 | −4.77 | +2.57 | +5.15 |
| 2 | MBT-C1 | −4.71 | −3.75 | +12.04 | +16.53 |
| Invention Example nr | | | | | |
| 1 | MBT-1 | −7.59 | −5.13 | +5.61 | +6.14 |
| 2 | MBT-2 | −6.06 | −3.74 | +3.5 | +4.55 |

COMPARATIVE EXAMPLES 3 AND 4

The substantially light-insensitive thermographic material of COMPARATIVE EXAMPLES 3 and 4 were prepared by coating a dispersion with the following ingredients in 2-butanone onto the support described for COMPARATIVE EXAMPLES 1 and 2 and INVENTION EXAMPLE 1 and 2 giving layers after drying at 85° C. for 3 minutes in a drying cupboard with the compositions given in Table 3.

TABLE 3

| | stabilizer of present invention | | AgBeh cover- | | R01 mol % | R02 mol % | T02 mol % | S01 mol % | S02 mol % | | |
|---|---|---|---|---|---|---|---|---|---|---|---|
| Comparative example nr. | type | mol % vs AgB | age [g/m$^2$] | BL5HP [g/m$^2$] | vs AgB | vs AgB | vs AgB | vs AgB | vs AgB | VL [g/m$^2$] | Oil [g/m$^2$] |
| 3 | S03 | 10 | 4.15 | 16.6 | 35 | 45 | 15 | 24 | 4.91 | 0.19 | 0.037 |
| 4 | MBT-C2 | 10 | 4.15 | 16.6 | 35 | 45 | 15 | 24 | 4.91 | 0.19 | 0.037 |

The thermosensitive elements were then provided with a protective layer as described for COMPARATIVE EXAMPLES 1 and 2 and INVENTION EXAMPLE 1 and 2.

The thermographic properties of the substantially light-insensitive thermographic recording materials of COMPARATIVE EXAMPLES 3 and 4 were evaluated as described for COMPARATIVE EXAMPLES 1 and 2 and INVENTION EXAMPLE 1 and 2. The results are given in Table 4.

TABLE 4

| Comparative | stabilizer | b* CIELAB-values of prints with fresh film | | Shift in CIELAB-values of prints after 3d/57° C./34% RH in dark | Shift of b* CIELAB-values, Δb*, of prints after 3d/30° C./85% RH light-box exposure | |
|---|---|---|---|---|---|---|
| Example | type | D = 1.0 | D = 2.0 | D = 1.0 | D = 1.0 | Dmin |
| 3 | S03 | −9.19 | −6.64 | +2.71 | +0.98 | +2.73 |
| 4 | MBT-C2 | −9.88 | −7.27 | +8.72 | +0.17 | +1.08 |

The results reported in Table 4 were generated with substantially light-insensitive thermographic recording materials with a different compositions from the substantially light-insensitive thermographic recording material on which the results reported in Table 2 were based. However, by comparing the results in the two table generated with substantially light-insensitive thermographic recording materials with the same stabilizer, the influence of this difference in composition can be estimated. The results for the substantially light-insensitive thermographic recording materials of COMPARATIVE EXAMPLE 1, COMPARATIVE EXAMPLE 3 and COMPARATIVE EXAMPLE 4 using stabilizer S03, benzotriazole are given in Table 5.

TABLE 5

| Comparative | stabilizer | b* CIELAB-values of prints with fresh film | | Shift in CIELAB-values of prints after 3d/57° C./34% RH in dark | Shift of b* CIELAB-values, Δb*, of prints after 3d/30° C./85% RH light-box exposure | |
|---|---|---|---|---|---|---|
| Example | type | D = 1.0 | D = 2.0 | D = 1.0 | D = 1.0 | Dmin |
| 1 | S03 | −5.92 | −4.77 | −0.81 | +2.57 | +5.15 |
| 3 | S03 | −9.19 | −6.64 | +2.71 | +0.98 | +2.73 |

This comparison shows that the composition of substantially light-insensitive thermographic recording material used for COMPARATIVE EXAMPLES 3 AND 4 gives:

more negative b*-values at D=1.0;

higher shifts in CIELAB b*-values after 3d/57° C./34% RH in the dark; and ca. 2.0 lower shifts in CIELAB b*-values after light-box exposure;

compared with the composition of substantially light-insensitive thermographic recording materials used for COMPARATIVE EXAMPLES 1 and 2 and INVENTION EXAMPLE 1 and 2. Bearing this information in mind the results reported in Tables 2 and 4 can be considered as a whole.

In the CIELAB-system a negative CIELAB b*-value indicates a bluish tone which becomes increasingly bluer as b* becomes more negative and a positive b*-value indicates a yellowish image-tone becoming more yellow as b* becomes more positive. In terms of the visual perception of an image as a whole, the image tone of elements of the image with a density of 1.0 have a stronger effect than the image tone of elements with lower or higher optical density.

In evaluating image tone the image tone of the SCOPIX™ LT2B silver halide emulsion laser medical hardcopy film from AGFA-GEVAERT has been used as a benchmark:

| D = 1.0 | | D = 2.0 | |
|---|---|---|---|
| CIELAB a*-value | CIELAB b*-value | CIELAB a*-value | CIELAB b*-value |
| −4.40 | −7.5 | −2.39 | −3.30 |

If the results for substantially light-insensitive thermographic recording materials containing 2-mercapto-benzothiazoles (MBT's) reported in Tables 2 and 4 are considered as a whole, the following conclusions can be drawn:

the substantially light-insensitive thermographic recording material of COMPARATIVE EXAMPLE 2 containing MBT-C1 exhibited poor stability to light in the light-box test as shown by high shifts in CIELAB b*-values at D=1.0 and Dmin;

the substantially light-insensitive thermographic recording material of COMPARATIVE EXAMPLE 4 containing MBT-C2 exhibited poor archival stability in the archivability box test as shown by high shifts in CIELAB b*-values at D=1.0; and the substantially light-insensitive thermographic recording materials of INVENTION EXAMPLES 1 and 2 containing MBT-1 and MBT-2 exhibited acceptable image tone, acceptable archival stability and much improved stability to light compared to the substantially light-insensitive thermographic recording material of COMPARATIVE EXAMPLE 4 containing MBT-C1.

COMPARATIVE EXAMPLE 5 TO 7 AND INVENTION EXAMPLES 3 TO 11

The substantially light-insensitive thermographic material of COMPARATIVE EXAMPLES 5 to 7 and INVENTION EXAMPLES 3 to 11 were prepared by coating a dispersion with the following ingredients in 2-butanone onto the support described for COMPARATIVE EXAMPLES 1 and 2 and INVENTION EXAMPLE 1 and 2 giving layers after drying at 85° C. for 3 minutes in a drying cupboard with the compositions given in Table 6.

TABLE 6

| | stabilizer | | | | | |
|---|---|---|---|---|---|---|
| | type | conc. mol % vs AgB | AgBeh coverage [g/m$^2$] | BL5HP [g/m$^2$] | R01 mol % vs AgB | R02 mol % vs AgB |
| Comparative example nr. | | | | | | |
| 5 | S03 | 10 | 4.15 | 16.60 | 35 | 45 |
| 6 | S03 | 10 | 4.15 | 16.60 | 35 | 45 |
| 7 | — | — | 4.15 | 16.60 | 35 | 45 |
| Invention example nr. | | | | | | |
| 3 | MBT-3 | 10 | 4.15 | 16.60 | 35 | 45 |
| 4 | MBT-4 | 10 | 4.15 | 16.60 | 35 | 45 |
| 5 | MBT-5 | 10 | 4.15 | 16.60 | 35 | 45 |
| 6 | MBT-6 | 10 | 4.15 | 16.60 | 35 | 45 |
| 7 | MBT-7 | 10 | 4.15 | 16.60 | 35 | 45 |
| 8 | MBT-8 | 10 | 4.15 | 16.60 | 35 | 45 |
| 9 | MBT-9 | 10 | 4.15 | 16.60 | 35 | 45 |
| 10 | MBT-10 | 10 | 4.15 | 16.60 | 35 | 45 |
| 11 | MBT-11 | 10 | 4.15 | 16.60 | 35 | 45 |

| | stabilizer | | | | | | |
|---|---|---|---|---|---|---|---|
| | type | conc. mol % vs AgB | T02 mol % vs AgB | S01 mol % vs AgB | S02 mol % vs AgB | VL [g/m$^2$] | Oil [g/m$^2$] |
| Comparative example nr. | | | | | | | |
| 5 | S03 | 10 | 15 | 24 | 4.91 | 0.19 | 0.037 |
| 6 | S03 | 10 | 15 | 24 | 4.91 | 0.19 | 0.037 |
| 7 | — | — | 15 | 24 | 4.91 | 0.19 | 0.037 |
| Invention example nr. | | | | | | | |
| 3 | MBT-3 | 10 | 15 | 24 | 4.91 | 0.19 | 0.037 |
| 4 | MBT-4 | 10 | 15 | 24 | 4.91 | 0.19 | 0.037 |
| 5 | MBT-5 | 10 | 15 | 24 | 4.91 | 0.19 | 0.037 |
| 6 | MBT-6 | 10 | 15 | 24 | 4.91 | 0.19 | 0.037 |
| 7 | MBT-7 | 10 | 15 | 24 | 4.91 | 0.19 | 0.037 |
| 8 | MBT-8 | 10 | 15 | 24 | 4.91 | 0.19 | 0.037 |
| 9 | MBT-9 | 10 | 15 | 24 | 4.91 | 0.19 | 0.037 |
| 10 | MBT-10 | 10 | 15 | 24 | 4.91 | 0.19 | 0.037 |
| 11 | MBT-11 | 10 | 15 | 24 | 4.91 | 0.19 | 0.037 |

The thermosensitive elements were then provided with a protective layer as described for COMPARATIVE EXAMPLES 1 and 2 and INVENTION EXAMPLE 1 and 2.

The thermographic properties of the substantially light-insensitive thermographic recording materials of COMPARATIVE EXAMPLE 5 to 7 and INVENTION EXAMPLES 3 to 11 were evaluated as described for COMPARATIVE EXAMPLES 1 and 2 and INVENTION EXAMPLE 1 and 2. The results are given in Table 7.

The substantially light-insensitive recording materials of INVENTION EXAMPLES 3 to 11 containing the stabilizers MBT-3 to MBT-11 exhibited improved light box stability i.e. reduced shifts in the CIELAB b*-value for Dmin compared with the substantially light-insensitive recording materials of COMPARATIVE EXAMPLES 7, without a stabilizer, and either comparable or reduced shifts in the CIELAB b*-value for Dmin compared with the substantially light-insensitive recording materials of COMPARATIVE EXAMPLES 8, with benzotriazole.

TABLE 7

| | stabilizer | b* CIELAB-values of prints with fresh film | | Shift of b* CIELAB-values, Δb*, of prints after 3d/30° C./85% RH light-box exposure | |
|---|---|---|---|---|---|
| | type | D = 1.0 | D = 2.0 | D = 1.0 | Dmin |
| Comparative Example nr. | | | | | |
| 5 | S03 | −8.99 | −6.88 | +0.49 | +1.55 |
| 6 | S03 | −9.96 | −7.43 | +0.45 | +1.56 |
| 7 | — | −5.98 | −2.86 | +0.14 | +2.16 |

TABLE 7-continued

| | stabilizer | b* CIELAB-values of prints with fresh film | | Shift of b* CIELAB-values, Δb*, of prints after 3d/30° C./85% RH light-box exposure | |
|---|---|---|---|---|---|
| | type | D = 1.0 | D = 2.0 | D = 1.0 | Dmin |
| Invention Example | | | | | |
| 3 | MBT-3 | −9.25 | −8.50 | +0.55 | +1.23 |
| 4 | MBT-4 | −9.65 | −8.01 | +0.48 | +0.75 |
| 5 | MBT-5 | −7.35 | −5.19 | +0.79 | +1.03 |
| 6 | MBT-6 | −9.48 | −7.19 | +1.23 | +0.91 |
| 7 | MBT-7 | −9.59 | −7.65 | +1.04 | +1.25 |
| 8 | MBT-8 | −9.83 | −7.38 | +2.1 | +1.55 |
| 9 | MBT-9 | −7.43 | −6.02 | +1.08 | +1.37 |
| 10 | MBT-10 | −8.50 | −5.73 | +1.21 | +1.20 |
| 11 | MBT-11 | −8.67 | −5.94 | +1.96 | +0.83 |

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention.

Having described in detail preferred embodiments of the current invention, it will now be apparent to those skilled in the art that numerous modifications can be made therein without departing from the scope of the invention as defined in the following claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A substantially light-insensitive black and white monosheet thermographic recording material comprising a support and a thermosensitive element, said thermosensitive element containing a substantially light-insensitive organic silver salt, an organic reducing agent therefor in thermal working relationship therewith, a binder and at least one 2-mercapto-benzothiazole compound represented by:

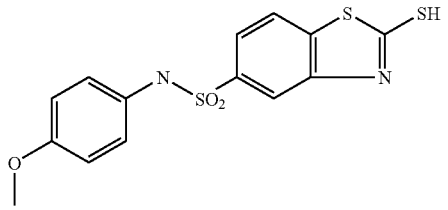

or by formula (I):

(I)

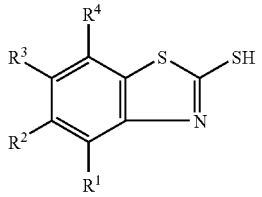

wherein $R^1$, $R^2$, $R^3$ and $R^4$ are independently hydrogen, an optionally substituted alkyl group, an optionally substituted aryl group, an alkoxy group, an ester group, a carbamate group, a carbonato group, a $SO_2R^5$ group, a $—NR_6R^7$ group, a nitro group, a cyano group, an acyl group; a halogen atom, an optionally alkyl or alkoxy-substituted $—SO_2NH$-phenyl group, a perfluoro-alkyl group, a $—CONHR^8$ group, a $—NHOCR^9$ group, a $—OCOOR^{10}$ group or a $—NHCOOR^{11}$ group; $R^3$ is an aryl group or an optionally substituted alkyl group; $R^9$, $R^{10}$ and $R^{11}$ are independently an optionally substituted alkyl or an aryl group; $R^6$, $R^7$ and $R^8$ are independently a hydrogen atom, an optionally substituted alkyl group or an acyl group; $R^1$ and $R^2$ together, $R^2$ and $R^3$ together and $R^3$ and $R^4$ together can independently represent the atoms necessary to form a carbocyclic, aromatic, heteroaromatic or heterocyclic ring with the proviso that at least one of $R^1$, $R^2$, $R^3$ and $R^4$ is not hydrogen.

2. The substantially light-insensitive black and white monosheet thermographic recording material according to claim 1, wherein at least one of said optionally substituted alkyl groups is substituted with a group selected from the group consisting of halogen atoms, groups containing a 2-mercapto-benzothiazole moiety and alkyl, alkoxy, mercapto and hydroxy groups.

3. The substantially light-insensitive black and white monosheet thermographic recording material according to claim 2, wherein at least one of said optionally substituted aryl groups is substituted with a group selected from the group consisting of halogen atoms, groups containing a 2-mercapto-benzothiazole moiety and alkyl, alkoxy, mercapto and hydroxy groups.

4. The substantially light-insensitive black and white monosheet thermographic recording material according to claim 3, wherein said thermosensitive element further comprises an optionally substituted benzotriazole.

5. The substantially light-insensitive black and white monosheet thermographic recording material according to claim 1, wherein at least one of said optionally substituted aryl groups is substituted with a group selected from the group consisting of halogen atoms, groups containing a 2-mercapto-benzothiazole moiety and alkyl, alkoxy, mercapto and hydroxy groups.

6. The substantially light-insensitive black and white monosheet thermographic recording material according to claim 1, wherein said thermosensitive element further comprises an optionally substituted benzotriazole.

7. A substantially light-insensitive black and white monosheet thermographic recording material comprising a support and a thermosensitive element, said thermosensitive element comprising a substantially light-insensitive organic silver salt, an organic reducing agent therefore in thermal working relationship therewith, a binder and at least one 2-mercapto-benzotriazole compound, wherein said at least one 2-mercapto-benzothiazole compound is a 2-mercapto-benzothiazole compound substituted by an alkyl, an aryl, an alkoxy, a nitro, a cyano or an acyl group or a halogen atom.

8. The substantially light-insensitive black and white monosheet thermographic recording material according to claim 7, wherein said thermosensitive element further comprises an optionally substituted benzotriazole.

9. A substantially light-insensitive black and white monosheet thermographic recording material comprising a support and a thermosensitive element, said thermosensitive element comprising a substantially light-insensitive organic silver salt, an organic reducing agent therefor in thermal working relationship therewith, a binder and at least one 2-mercapto-benzotriazole compound, wherein said at least one 2-mercapto benzothiazole compound is

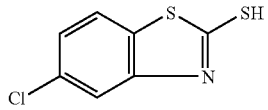

or

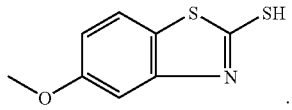

10. The substantially light-insensitive black and white monosheet thermographic recording material according to claim 7, wherein said at least one 2-mercapto benzothiazole compound is

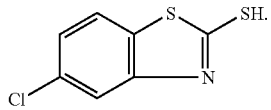

11. The substantially light-insensitive black and white monosheet thermographic recording material according to claim 10, wherein said thermosensitive element further comprises an optionally substituted benzotriazole.

12. The substantially light-insensitive black and white monosheet thermographic recording material according to claim 9, wherein said at least one 2-mercapto benzothiazole compound is

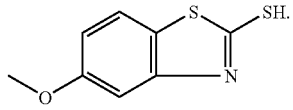

13. The substantially light-insensitive black and white monosheet thermographic recording material according to claim 12, wherein said thermosensitive element further comprises an optionally substituted benzotriazole.

14. A substantially light-insensitive black and white monosheet thermographic recording material comprising a support and a thermosensitive element, said thermosensitive element comprising a substantially light-insensitive organic silver salt, an organic reducing agent therefor in thermal working relationship therewith, a binder and at least one 2-mercapto-benzotriazole compound, wherein said at least one 2-mercapto-benzotriazole compound is

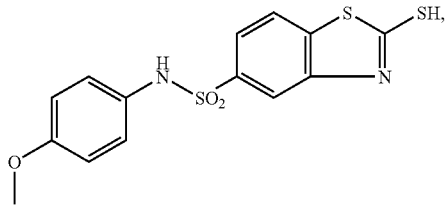

or

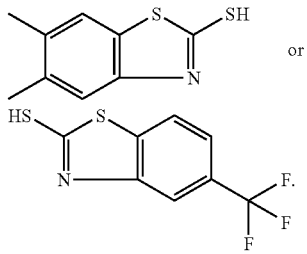

15. The substantially light-insensitive black and white monosheet thermographic recording material according to claim 14, wherein said at least one 2-mercapto benzothiazole compound is

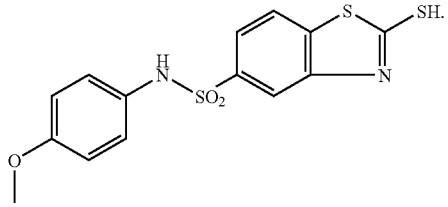

16. The substantially light-insensitive black and white monosheet thermographic recording material according to claim 15, wherein said thermosensitive element further comprises an optionally substituted benzotriazole.

17. The substantially light-insensitive black and white monosheet thermographic recording material according to claim 14, wherein said at least one 2-mercapto benzothiazole compound is

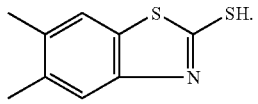

18. The substantially light-insensitive black and white monosheet thermographic recording material according to claim 17, wherein said thermosensitive element further comprises an optionally substituted benzotriazole.

19. The substantially light-insensitive black and white monosheet thermographic recording material according to claim 14, wherein said at least one 2-mercapto benzothiazole compound is

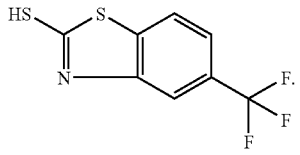

20. The substantially light-insensitive black and white monosheet thermographic recording material according to claim 19, wherein said thermosensitive element further comprises an optionally substituted benzotriazole.

* * * * *